US006508173B1

(12) United States Patent
Focke et al.

(10) Patent No.: US 6,508,173 B1
(45) Date of Patent: Jan. 21, 2003

(54) PROCESS AND APPARATUS FOR PRINTING BLANKS

(75) Inventors: Heinz Focke, Verden (DE); Eckhard Grundmann, Bruchhausen-Vilsen (DE)

(73) Assignee: Focke & Co. (GmbH & Co.), Verden (DE)

( * ) Notice: Subject to any disclaimer, the term of this patent is extended or adjusted under 35 U.S.C. 154(b) by 0 days.

(21) Appl. No.: 09/526,809

(22) Filed: Mar. 16, 2000

(30) Foreign Application Priority Data

Mar. 26, 1999 (DE) ..... 199 13 855

(51) Int. Cl.[7] ..... B41F 1/34
(52) U.S. Cl. ..... 101/485; 101/228
(58) Field of Search ..... 101/228, 288, 101/484, 485

(56) References Cited

U.S. PATENT DOCUMENTS 4,262,474 A 4/1981 Reuter et al.
5,397,424 A * 3/1995 Sakano et al. ..... 156/502
5,540,146 A * 7/1996 Lapp ..... 101/152

FOREIGN PATENT DOCUMENTS

| | | |
|---|---|---|
| DE | 195 35 535 A1 | 3/1997 |
| DE | 197 26 324 A1 | 12/1998 |
| DE | 197 42 537 A1 | 4/1999 |
| EP | 0 905 027 A1 | 3/1999 |
| GB | 2 142 282 A | 1/1985 |

* cited by examiner

*Primary Examiner*—Ren Yan
(74) *Attorney, Agent, or Firm*—Todd Deveau; Ryan A. Schneider; Troutman Sanders LLP

(57) ABSTRACT

For the purpose of providing markings, in particular printing, on a material web (11) for producing blanks (10), the material web (11) is stopped temporarily, with the result that a printing unit (34) can provide the marking or printing. In order to ensure that the marking is positioned precisely in each case, the relative positioning between the material web (11) and printing unit (34) is controlled by a printed-mark reader (37), which is assigned to the printing unit (34). In the case of incorrect positioning, the material web (11) is moved, for correction purposes, in the conveying direction or counter to this until the correct relative positioning is achieved.

4 Claims, 2 Drawing Sheets

20
23
22
19
11
17
21
36
37
34
35
18
16
15
29
26
12
11
24
28
27
30
14
25
13
10

10
11
25
30
31
32
33
34
37
38
39
40
41
42

PROCESS AND APPARATUS FOR PRINTING BLANKS

FIELD OF THE INVENTION

The invention relates to a process for providing markings, in particular printing, on blanks for the production of packs, the blanks being severed from a continuous material web by a severing element. The invention also relates to an apparatus for carrying out the process.

BACKGROUND OF THE INVENTION

In packaging technology, it is often necessary for packs, namely the (outer) wrapper thereof, to be provided with printing or some other marking. In the production of cigarette packs or multipacks for cigarettes, there is often a need for data concerning the time and place of production to be provided, in the region of the packaging machine or following the same, by corresponding printing on the packaging material, in particular on an outer wrapper for multipacks. A suitable printing unit is used for this purpose.

The marking or printing is to be provided on a precise location of the wrapper. It is thus necessary for the printing unit to be controlled correspondingly, namely to be actuated such that the printing is provided at the envisaged position.

SUMMARY OF THE INVENTION

The object of the invention is to provide measures which ensure precise positioning of the printing or some other marking on a blank for a pack, in particular multipack.

In order to achieve this object, the process according to the invention is characterized by the following features:

a) the markings or printing are/is provided on a continuous material web for the production of blanks during temporary storage of the material web, which is otherwise transported continuously, b) the positioning of the markings or printing can be controlled by a printed-mark reader which detects printed marks on the material web, c) detected incorrect positioning is compensated by relative movement between the printing unit and material web.

In the case of the process according to the invention, the correct position of the printing is thus ensured by markings on the material web being sensed and, in the case of any incorrect positioning, the material web is preferably moved in the conveying direction or counter to this during the stoppage phase to such an extent that the printing unit applies the printing at the precise predetermined position.

In the case of the process according to the invention, incorrect positioning of the material web relative to the marking element or relative to the printing unit is thus established and compensated by relative movement, in particular by the virtue of the material web being drawn forwards or back.

The apparatus according to the invention is characterized in that a printed-mark reader is assigned to the marking element or printing unit and is arranged upstream thereof, in the conveying direction. This printed-mark reader checks the correct positioning of the material web during the marking operation, that is to say during the temporary stoppage. Any adjustment movements of the material web are compensated by a pendulum mechanism for the web in conjunction with a rearward-conveying drive for the web.

BRIEF DESCRIPTION OF THE DRAWINGS

Further details of the process and of the apparatus are explained in more detail hereinbelow with reference to drawings, in which.

DETAILED DESCRIPTION OF A PREFERRED EMBODIMENT

Figure 1:
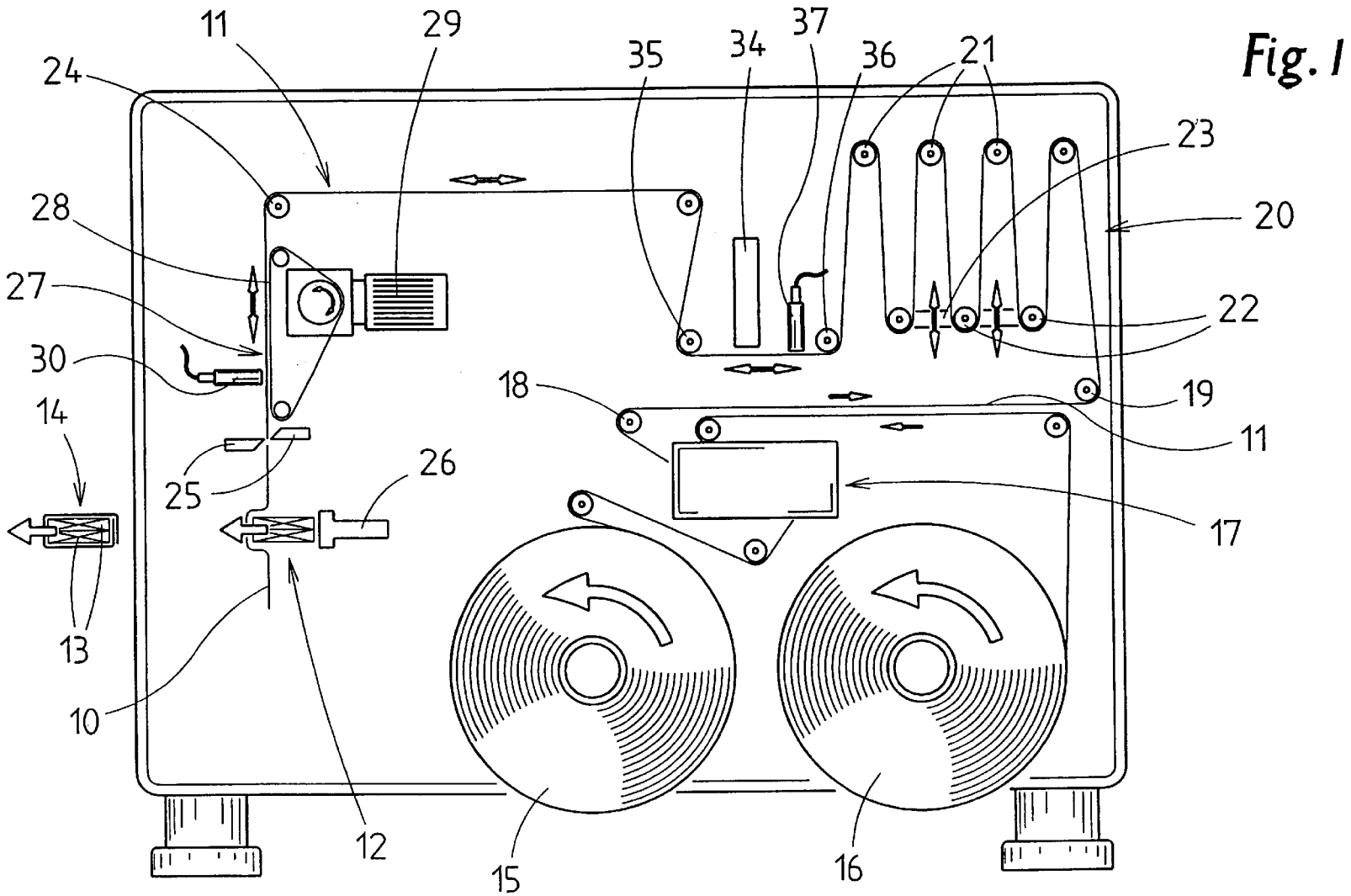
FIG. 1 shows an apparatus for producing blanks as part of a packaging machine.

The embodiment illustrated in the drawings concerns the production of blanks 10 by severing from a continuous material web 11. In this case, the apparatus is part of a packaging line for cigarettes. The blanks 10 serve, in the present case, for wrapping a group 12 of cigarette packs 13 for producing multipacks 14.

The material web, consisting, for example, of paper or film is drawn off from a reel 15. A second reel 16 is kept on standby for connection to the finishing material web 11 once the reel 15 has been used up. The new material web is connected to the finishing material web 11 by a splicing device 17 of known, suitable construction.

The finishing material web 11 is guided, over deflecting rollers 18, 19, through a web store. The web store serves as an element for compensating non-uniform conveying movements of the material web 11. The latter stops temporarily, namely during the severing of the blank 10. The material web 11 is pushed up continuously in the region upstream of the web store.

The web store is designed as a pendulum-type store 20. This comprises a plurality of (top) fixed rollers 21 and pendulum rollers 22 which interact with said fixed rollers and can be moved up and down. The material web is guided back and forth and/or up and down over the fixed rollers 21 and pendulum rollers 22. The pendulum rollers 22 are mounted on a common support 23 which can be moved up and down.

The pendulum-type store 20 acts such that, during the stoppage of the material web 1 1 , material web 11 conveyed in subsequently from the reel 15 or 16 is accommodated by the pendulum-type store 20. In this case, the pendulum rollers 22 and the carrier 23 are moved downwards with the same. The pendulum rollers 22, with the support 23, expediently rest, on account of their own weight, on the lip of the material web 11 and are moved downwards under their own weight if material web 11 is fed in from one side.

Upon continuation of the conveying movement of the material web 11 on the outlet side of the pendulum-type store 20, the pendulum rollers 22 are moved upwards, the storage quantity of material web 11 being reduced in the process. During the next stoppage of the material web 11, the operation described is repeated.

Following a horizontal conveying section, the material web 11 is deflected over a deflecting roller 24 into a vertical, downwardly directed conveying plane. In this region, the blanks 10 are severed one after the other by a severing cutter 25. The material web 11 is stopped as the severing cut is carried out. The pack group 12 is conveyed transversely to the plane of the blank 10 by a pusher 26, as a result of which said blank is carried along by the pack group 12 and is folded around the pack contents in a U-shaped manner.

The material web 11 is fed to the severing device or the severing cutter 25 by a separate conveyor, in the present case by a driven suction belt 27. This grips the material web 11 by way of an upright conveying strand 28 and moves the material web downwards, to be precise by a distance corresponding to the length of the blank 10. The suction belt 27 is driven by a motor 29 which can have its direction of rotation reversed.

The precise positioning of the severing cut for severing the blank 10 is controlled by a separate monitoring element, namely by a printed-mark reader 30. The latter senses printed marks 31 provided on the material web 11 in an accurately positioned manner. The printed marks 31 are spaced apart from one another by distances corresponding to the length of the blank 10. Once the printed mark 31 is detected by the printed-mark reader 30, the material web 11 is stopped and the severing cut is executed along a cutting line 32.

The blanks are provided with a marking, to be precise with printing 33. This may contain data concerning production time, place and further information. The printing is applied by a marking element, namely by a printing unit 34. This is used in the region of a horizontal conveying section of the material web 11, between two deflecting rollers 35, 36 positioned in the same horizontal plane. This horizontal section of the material web 11, or the marking station formed by the printing unit 34, is positioned directly following the pendulum-type store 20, to be precise at a relatively large distance from the severing station for the blanks 10.

For the purpose of providing the printing 33, the printing unit 34 is lowered onto the material web 11 from above during the stoppage of said material web. The printing unit 34 is thus also controlled indirectly by the printed-mark reader 30, since the latter causes the stoppage of the material web 11.

In order to ensure that the printing 33 is always provided at the predetermined, desired position—in the present example at a distance from the cutting line 32—the printing unit 34 is assigned a (further) printed-mark reader 37. The latter is likewise located in the region between the deflecting rollers 35, 36, to be precise upstream of the printing unit 34, in the conveying direction of the material web 11. The printed-mark reader 37 likewise senses the printed marks 31. It is thus possible to establish directly in the region of the printing unit 34 incorrect positioning of the (stopped) material web 11 relative to the printing unit 34. Movement compensation between the printing unit 34 and material web 11 then takes place such that the incorrect positioning is compensated and the printing 33 is provided at the correct location.

Incorrect positioning of the material web 11, or of the blanks 10 which are to be produced, relative to the printing unit 34 is compensated by relative movement between the material web 11 and printing unit 34. In the case of the present example, the material web 11 is displaced with the printing unit 34 stationary. If, on account of corresponding incorrect positioning, the material web 11 has to moved further in the original conveying direction, this additional conveying movement can be executed by the suction belt 27—following the severing of the blank 10 but still during the stoppage phase. More advantageous, however, is compensation by virtue of the material web 11 being conveyed in the opposite direction, that is to say in the rearward direction. For this purpose, once the blank 10 has been severed, the direction of rotation of the suction belt 27 is reversed. The material web 11 is drawn back, under the action of the pendulum-type store 20 as well, since the moveable pendulum rollers 22 draw back the material web 11 under their own weight—if necessary in conjunction with an additional force—into the pendulum-type store 20 until the precise positioning for providing the printing 33 has been reached. Once their printing has been provided, the material web 11 is transported further in the customary manner for the purpose of producing the next blank 10.

Figures 2, 3, 4:
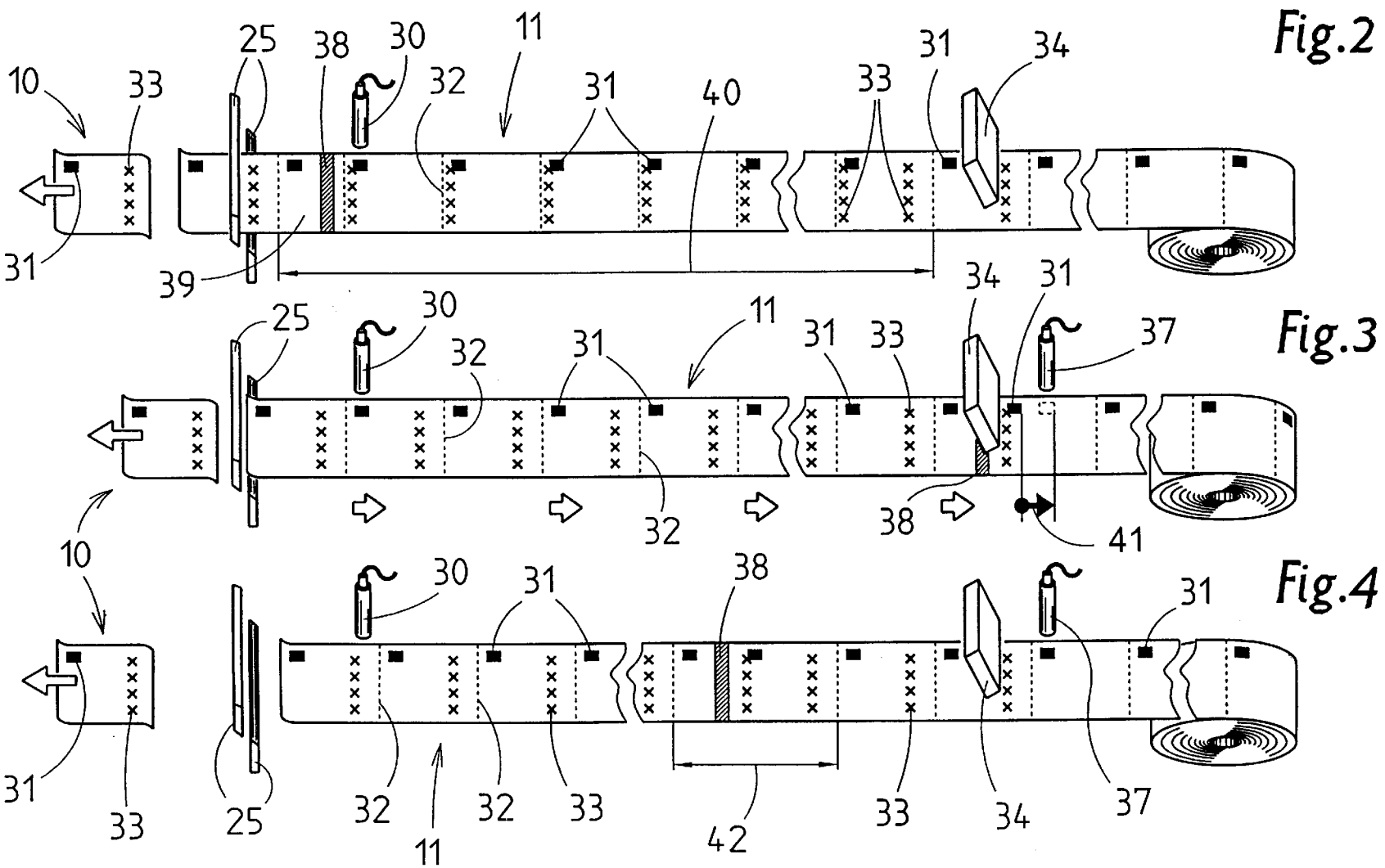
FIG. 2 shows a perspective illustration of a schematically illustrated material web with printing unit.
FIG. 3 shows an illustration analogous to FIG. 2 with movement compensation for the material web.
FIG. 4 shows an illustration corresponding to FIG. 3 with different relative positioning of the material web.

The occurrence and elimination of incorrect positioning in the region of the material web 11 are explained with reference to FIGS. 2, 3 and 4. In this case, the incorrect positioning arises as a result of splicing, that is to say connection of a finishing material web to a new material web in the region of the splicing device 17. The web forms a connecting location 38, which may be, for example, an adhesive strip. The splicing operation produces a defective blank 39, which is shorter than the conventional blanks 10 on account of the smaller distance between successive printed marks 31. FIG. 2 shows the resulting consequences for providing the printing when there is no incorrect-positioning compensation. All the blanks which are located in the region of a conveying section 40 between the printing unit 34 and the severing station or the severing cutters 25 have the printing 33 in the incorrect position. It is only once the defective blank 39 has passed through the region of the severing cutters 25 that correct positioning of the printing 33 is achieved again, because the distance between the severing cutter 25 and printing unit 34 corresponds to a multiple of the length of a blank. In the case of the example shown (FIG. 2), there are seven blanks 10 of correct length, but with the printing 33 in the incorrect position.

In the case of the arrangement according to FIG. 3, the incorrect positioning is detected as soon as the defective blank 39 and the corresponding printed marks 31 pass into the region of the (additional) printed-mark reader 37. The defective blank 39 has printing provided on it in the incorrect position. In the case of the following (correct) blank 10, however, the length difference is compensated by virtue of the material web 11 being drawn back or conveyed back by a compensation distance 41. This is detected by the printed-mark reader 37 and produced in the manner described. The compensation, namely the material web 11 being conveyed back by the compensation distance 41, has to be carried out until the defective blank 39 has passed the severing location. As can be seen from FIG. 4, there is merely a comparatively short defective section 42 which is not suitable for processing as a pack wrapper. This defective section 42 is separated out.

The measures described may also be used when a (temporary) format change takes place, that is to say when blanks 10 of longer or shorter length are to be produced for a specific operating period or when different positioning of the printing 33 is required. Here too with the aid of the printed-mark reader 37, the printing 33 can be applied at the desired, correct position each time.

List of Designations

10 Blank
11 Material web
12 Pack group
13 Cigarette pack
14 Multipack
15 Reel
16 Reel
17 Splicing device
18 Deflecting roller
19 Deflecting roller
20 Pendulum-type store
21 Fixed roller

22 Pendulum roller
23 Support
24 Deflecting roller
25 Severing cutter
26 Pusher
27 Suction belt
28 Conveying strand
29 Motor
30 Printed-mark reader
31 Printed mark
32 Cutting line
33 Printing
34 Printing unit
35 Deflecting roller
36 Deflecting roller
37 Printed-mark reader
38 Connecting location
39 Defective blank
40 Conveying section
41 Compensation distance
42 Defective section

We claim:

1. A process for providing printing (33) on a continuous material web (11) having printed marks (31) and for precise severing of blanks (10) from the material web (10), comprising the following steps:

determining with a printed-mark reader (30) where to sever the material web to create blanks (10);

determining the positioning of the printing (33) on the material web (11) with a second printed-mark reader (37) for sensing printed marks (31) on the material web (11);

compensating for incorrect positioning of the material web (11) relative to a printing unit (34) by displacing the material web (11) relative the printing unit (34) such that the printed marks (31) on the material web (11) correspond with the printing unit (34); and providing the printing 33 to the web (11) with the printing unit (34) being adjacent to the web in response to displacing the material web (11)

wherein the step of compensating for the incorrect positioning of the material web (11) by displacing the material web (11) is performed by a driven belt (27) in the proximity of cutters (25) to convey the material web (11) in one direction and a web store (20) to carry the material web (11) in another direction.

2. The process of claim 1 further comprising the step of stopping the material web (11) for the printing unit (34) To provide the printing (33) on the material web (11) while severing the web (11) to create the blanks (10).

3. The process of claim 1 wherein the step of compensating for the incorrect positioning of the material web (11) by displacing the material web (11) is performed by displacing the material web relative the printing unit (34) in two opposite directions.

4. The process of claim 1 wherein the web store (20) is a pendulum-type store.

* * * * *